US007614195B2

(12) United States Patent
Platt et al.

(10) Patent No.: US 7,614,195 B2
(45) Date of Patent: Nov. 10, 2009

(54) SUSPENDED CEILING GRID NETWORK UTILIZING SEISMIC SEPARATION JOINT CLIPS

(75) Inventors: William J. Platt, Aston, PA (US); Sandor Frecska, Mannington, WV (US)

(73) Assignee: Worthington Armstrong Venture, Malvern, PA (US)

( * ) Notice: Subject to any disclaimer, the term of this patent is extended or adjusted under 35 U.S.C. 154(b) by 10 days.

(21) Appl. No.: 11/895,986

(22) Filed: Aug. 27, 2007

(65) Prior Publication Data

US 2008/0060306 A1 Mar. 13, 2008

Related U.S. Application Data

(63) Continuation-in-part of application No. 10/592,614, filed on Sep. 12, 2006.

(51) Int. Cl.
*E04B 9/00* (2006.01)
*E04C 2/42* (2006.01)
*E04C 5/00* (2006.01)

(52) U.S. Cl. ..... 52/506.06; 52/665; 52/714

(58) Field of Classification Search ..... 52/512, 52/664–669, 506.05–506.07, 712–715; 403/346
See application file for complete search history.

(56) References Cited

U.S. PATENT DOCUMENTS

| | | | | | |
|---|---|---|---|---|---|
| 3,089,570 | A | * | 5/1963 | O'Neil, Jr. | 52/713 |
| 3,216,537 | A | * | 11/1965 | Nelsson | 403/219 |
| 3,677,589 | A | | 7/1972 | Roles | |
| 3,798,865 | A | | 3/1974 | Curtis | |
| 4,193,247 | A | * | 3/1980 | Heckelsberg | 52/713 |
| 4,479,341 | A | | 10/1984 | Schuplin | |
| 4,559,751 | A | | 12/1985 | Rogers | |
| 4,583,340 | A | | 4/1986 | Sauer | |
| 4,640,077 | A | | 2/1987 | Hall | |
| 4,680,910 | A | | 7/1987 | Perk | |
| 4,715,161 | A | | 12/1987 | Carraro et al. | |
| 4,785,603 | A | | 11/1988 | Platt | |
| 5,046,294 | A | | 9/1991 | Platt | |
| 5,349,800 | A | | 9/1994 | Peng | |
| 5,572,844 | A | * | 11/1996 | Stackenwalt et al. | 52/506.07 |
| 5,743,063 | A | * | 4/1998 | Boozer | 52/713 |
| 5,846,018 | A | * | 12/1998 | Frobosilo et al. | 403/403 |
| 5,941,029 | A | | 8/1999 | MacLeod | |
| 6,138,416 | A | | 10/2000 | Platt | |
| 6,178,712 | B1 | | 1/2001 | Sauer | |
| 6,516,582 | B2 | * | 2/2003 | Paul et al. | 52/506.07 |
| 7,293,393 | B2 | * | 11/2007 | Kelly et al. | 52/665 |
| 2005/0160696 | A1 | * | 7/2005 | Kelly et al. | 52/712 |

* cited by examiner

*Primary Examiner*—Richard E Chilcot, Jr.
*Assistant Examiner*—Elizabeth A Plummer
(74) *Attorney, Agent, or Firm*—Eugene Chovanes

(57) ABSTRACT

Joint clips of the invention are used in grids for suspended ceilings, at selected intersections, to create separate areas of ceiling that move independently of one another during an earthquake, to prevent a buildup of momentum in the entire ceiling. In one embodiment disclosed herein, the clips extend laterally of a selected main beam, and are formed of a pair of loosely connected identical segments that are slidably secured to a selected main beam by a cut-out in the segments. The clip extends laterally across a selected main beam and slidably receives the end of a cross beam in a pocket of the clip that extends laterally on each side of the selected main beam.

5 Claims, 10 Drawing Sheets

12
10
M
42
16
24
20
22
32
40
30
L
14
18
42
32
25
16
40
38
18
14
18

20

22
32
34
36
39
38
37

FIG.12
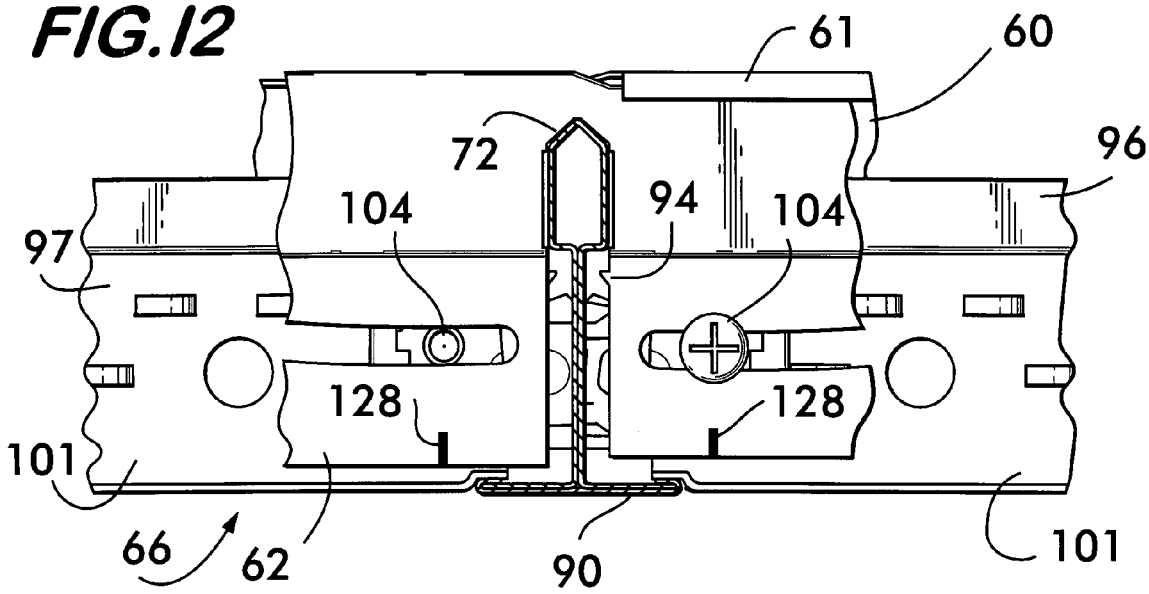
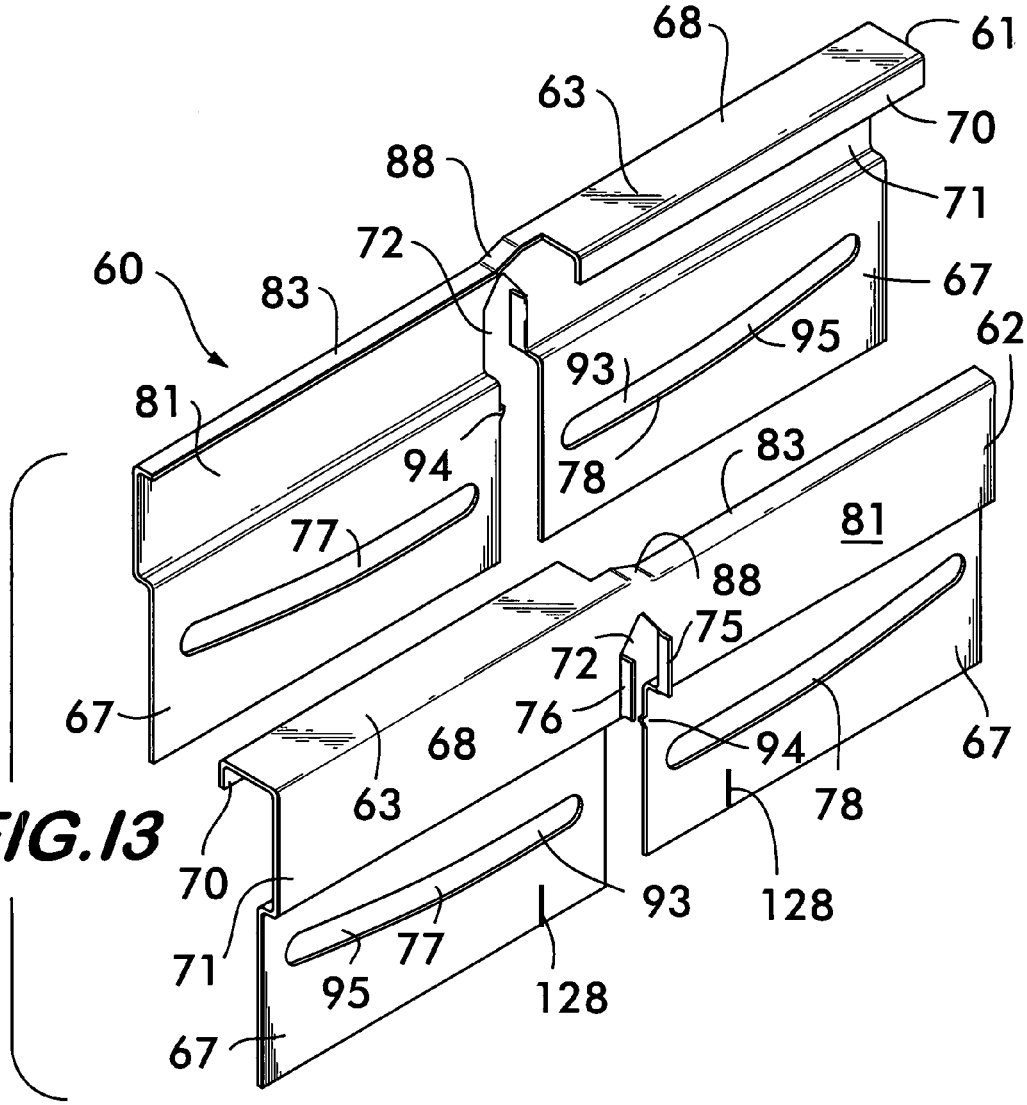
FIG.13

SUSPENDED CEILING GRID NETWORK UTILIZING SEISMIC SEPARATION JOINT CLIPS

CROSS REFERENCE TO RELATED APPLICATION

This application is a continuation-in-part of U.S. application Ser. No. 10/592,614, filed Sep. 12, 2006, entitled Suspended Ceiling Grid Network Utilizing Seismic Separation Joint Clips, which claims the benefit under 35 U.S.C. §119(e) of U.S. provisional application Ser. No. 60/536,427, filed Jan. 14, 2004, entitled "Suspended Ceiling System Utilizing Seismic Separation Joint Clips".

BACKGROUND OF THE INVENTION

The invention relates to a suspended ceiling grid network which utilizes clips to connect a primary grid member to a secondary or cross grid member in a generally perpendicular relationship. More specifically, the invention relates to a grid network having a clip which permits lateral movement of the cross grid member relative to the primary grid member in at least two horizontal directions with respect to the ceiling plane, while maintaining the assembled relationship of the primary and cross grid members.

Clips for securing two grid members in generally perpendicular relation to one another in order to form a ceiling grid network are widely known in the art. In geographical regions subject to earthquakes, steel buildings are designed with lateral force resisting (seismic) systems to resist the effects of earthquake forces. Seismic systems make a building stiffer against horizontal forces, thus minimizing the amount of relative lateral movement and resultant damage. Although the buildings may be designed structurally to provide seismic resistance to lateral forces, suspension ceiling systems remain very susceptible to displacement under seismic conditions.

ASTM E 580-02 provides a standard practice for "Application of Ceiling Suspension Systems for Acoustical Tile and Lay-in Panels in Areas Requiring Seismic Restraint." This standard practice covers acoustical ceiling suspension systems and their additional requirement for application both in areas subject to light to moderate seismic disturbance such as Uniform Building Code (UBC) Seismic Zone 2, and areas subject to moderate to severe seismic disturbance such as UBC Seismic Zones 3 and 4. The intent of this standard practice is to provide an unrestrained ceiling system designed to accommodate the horizontal movement of the grid network when loads are applied laterally to a ceiling surface, such as during a seismic event. ASTM E 580-02 requires, in areas subject to light to moderate seismic disturbance, that the primary and cross grid members of the ceiling system, including their splices, connectors and expansion devices be designed and built to carry an average test load of 60 lbs. in tension with a 5 degree misalignment of the primary and cross grid members in any direction.

Typically, a ceiling system having a ceiling area of less than 2500 square feet, is attached to the wall via wall angles on two adjacent sides. On the other two sides, wall angles with 2 inch horizontal legs are used along with spacer bars and hanger wires. Thus, during a seismic event, the grid members abutting the wall can move laterally away from the wall, i.e. float on the 2 inch perimeter wall angle. The 2 inch wall angles provide the 5 degree misalignment of the primary and cross runners in the direction of the horizontal ceiling plane as required by ASTM E 580-02.

In order to comply with ASTM E 580-02 at an interior ceiling location, one solution that has been contemplated by those skilled in the art is to utilize primary and cross grid members having four inch horizontal flanges, in other words, two inch flanges on either side of the vertical web. This solution effectively provides the same effect as the 2 inch wall angles at an interior ceiling location. However, from an aesthetic standpoint, it is undesirable to use grid members having such wide flanges.

Additionally, the 2000 International Building Code specifies that "for ceiling areas exceeding 2500 square feet a seismic separation joint or full height partition shall be provided." Essentially, this requires a large ceiling area to be segmented into independent smaller areas to prevent the ceiling from completely collapsing during a seismic event.

In order to comply with both ASTM E 580-02 and the 2000 International Building Code, a grid network is needed which eliminates primary grid members having 4 inch lower flanges and which partitions a single ceiling area into smaller independent ceiling areas.

BRIEF SUMMARY OF THE INVENTION

The present invention is a ceiling system having a primary grid network which has a plurality of grid members disposed in generally perpendicular relation forming a plurality of intersection points. The primary grid network is partitioned into more than one grid network by attaching a joint clip of the invention at points of intersection of the grid members.

Each clip, which, in one embodiment of the invention, can be formed from a single piece of resilient sheet metal, secures first and second cross grid members to the primary grid member. The clip has a first resilient fastening portion that extends in the longitudinal direction of the primary grid member and attaches to the primary grid member. The clip also has a second resilient fastening portion that extends from the first fastening portion at a right angle. The clip further includes a third resilient fastening portion that extends from the first fastening portion at a right angle on the side of the first fastening portion opposite the second fastening portion.

Each clip, in another embodiment of the invention is formed from two identical segments that loosely telescope together and ride independently on a main beam during a quake, with cross beams slidably supported in pockets with slots formed by the telescoped segments.

In the embodiments disclosed, the joint clips of the invention partition the primary grid network into smaller networks, or islands. Each smaller grid network or island, is capable of moving independently of neighboring grid networks, or islands, while at the same time, preserving the aesthetic appeal of the overall grid network. The clip adds structural strength to the overall grid framework to prevent twisting and withdrawal of the cross grid members from the primary grid member.

BRIEF DESCRIPTION OF THE SEVERAL VIEWS OF THE DRAWING

FIG. 12 is a view of the connection shown in FIGS. 10 and 11, with the joint clip of the invention, partially broken away, installed.

FIG. 13 is a perspective view of the embodiment of the joint clip of the invention shown in FIG. 12, with the parts separated.

DETAILED DESCRIPTION OF THE INVENTION

1. The Embodiments of the Joint Clips shown in FIGS. 1 through 11

The following description of the invention is provided as an enabling teaching of the invention in its best, currently known embodiments. Those skilled in the relevant art will recognize that many changes can be made to the embodiments described while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and may even be desirable in certain circumstances and are a part of the present invention. Thus, the following description is provided as illustrative of the principles of the present invention and not in limitation thereof, since the scope of the present invention is defined by the claims.

The ceiling grid network of the invention includes a plurality of primary and cross grid members. The grid members shown throughout the drawings are of a generally inverted T-cross section, which are well known in the art. However, it should be noted that other grid members could be used in the grid network of the invention. The primary and cross grid members are typically spaced in perpendicular relation to accommodate ceiling panels and other suspended ceiling equipment, such as light fixtures. The grid network formed can be suspended from a stationary fixed ceiling.

Figure 1:
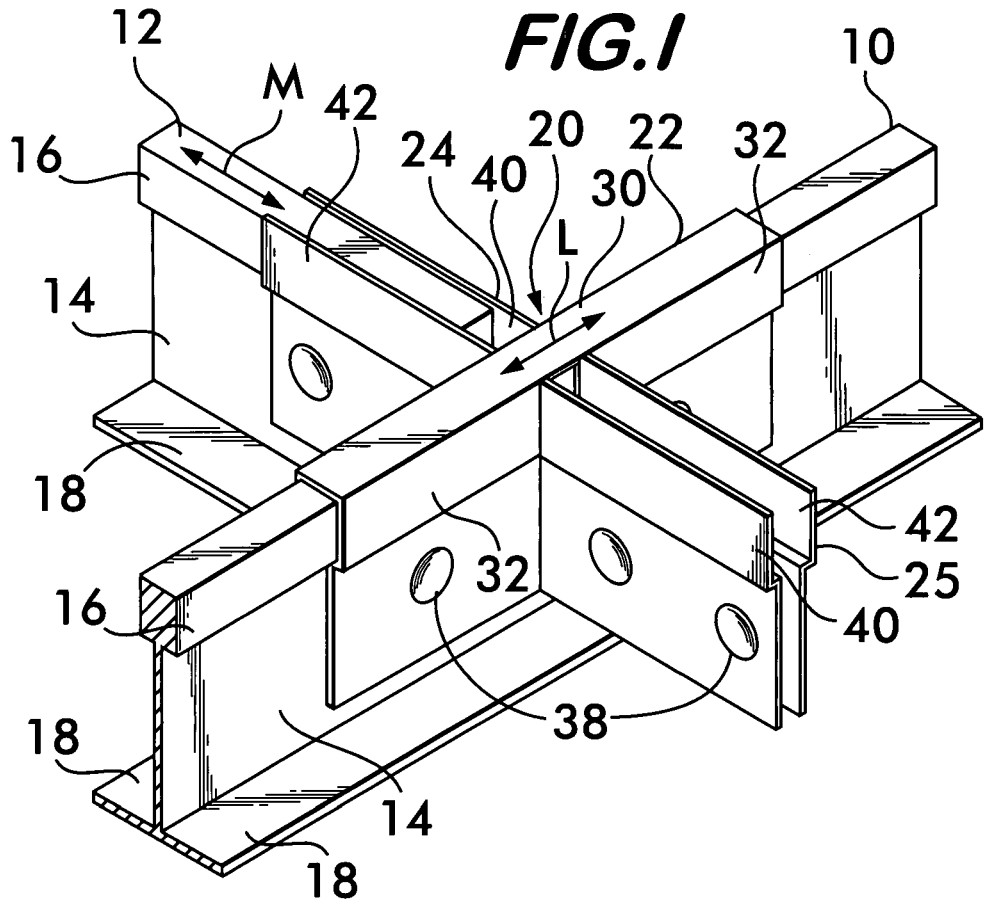
FIG. 1 is a fragmentary perspective view of the ceiling system illustrating the joint portion of the system to which an example embodiment of a clip of the invention is shown mounted.

Referring now to FIGS. 1-3 and 7, the intersection of a primary grid member (main beam) and a cross grid member (cross beam) is shown. As shown in FIG. 1, the cross grid member 12 is disposed in generally perpendicular relation to the primary grid member 10. Each of the grid members 10, 12 comprise a web 14 extending generally vertically and flange 18 extending horizontally from both sides of the vertical web 14. The vertical web 14 may include a bulb portion 16 at an end of the vertical web 14 opposite the horizontal flange 18. Although the bulb portion 16 is shown throughout the drawings as having a rectilinear cross section, the bulb can have several different configurations, such as a generally circular cross shape, or a peaked shape, such as shown in U.S. Pat. No. 6,138,416, incorporated herein by reference.

Figure 2:
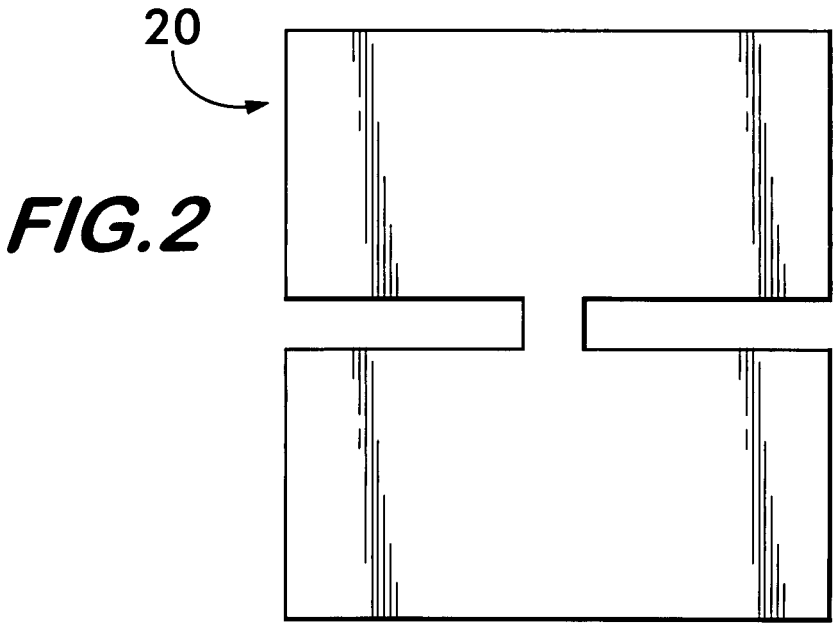
FIG. 2 is a plan view of the example embodiment of the clip shown in FIG. 1 prior to being bent into shape.

A joint clip 20 is attached to the grid network at an intersecting point of the primary 10 and cross grid members 12. In the example embodiment shown in FIG. 1, the clip 20 is formed of a single flat piece of generally resilient, yet flexible, material, such as spring steel material. The material may be stamped using mass production techniques well known in the art. FIG. 2 shows the clip 20 of FIG. 1 in its unbent form. When bent into its finished shape, the clip, when viewed from the top, is of general cross shape.

Figure 7:
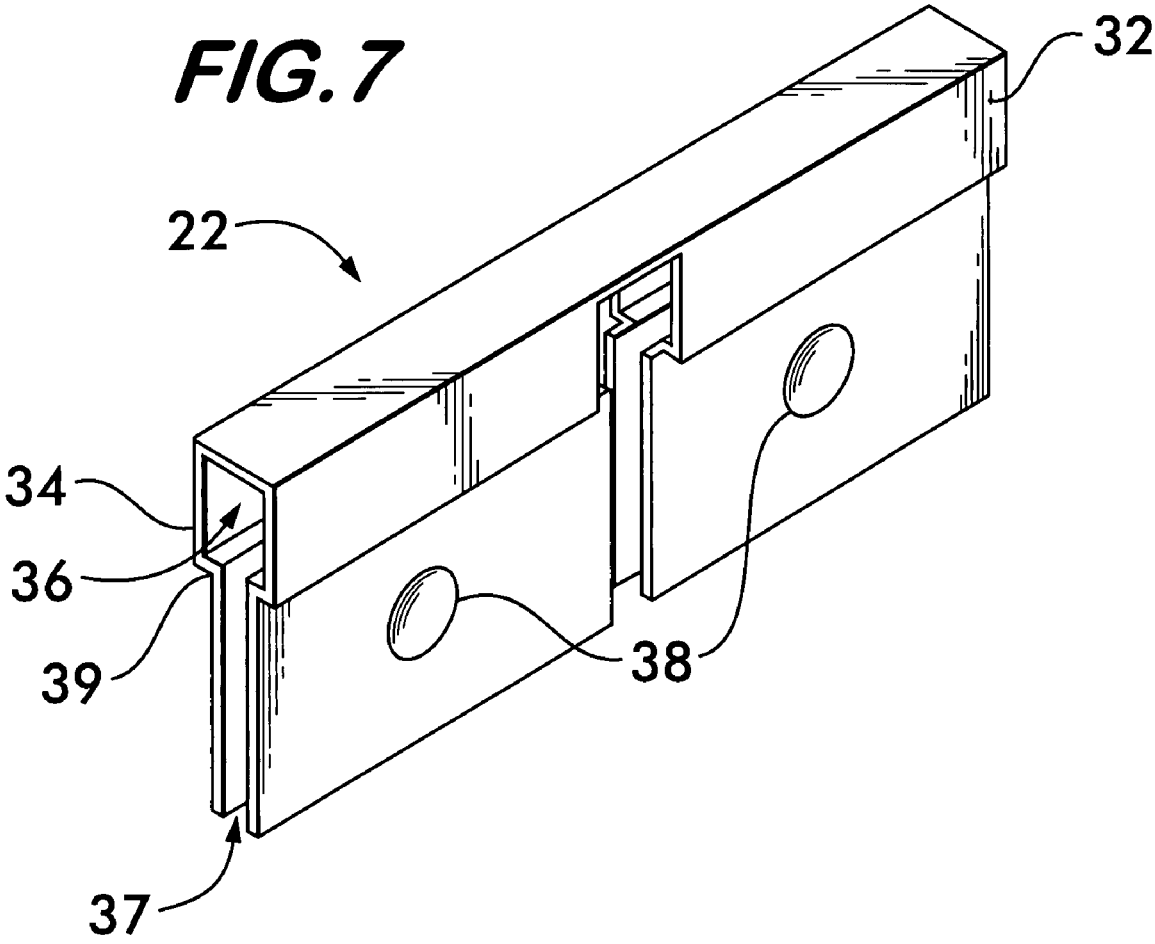
FIG. 7 is a perspective view of the first fastener portion of the clip of FIG. 1.

A first resilient fastener portion 22 of clip 20 is attached to a primary grid member 10. As best seen in FIG. 7, the first resilient fastener portion 22 has two opposing legs 32, 34 which form a downwardly opening channel 36 for straddling the vertical web 14 of a primary grid member 10. Preferably, the first fastener portion 22 is configured so that its opposed legs 32, 34 follow the geometry of the vertical web 14 of the primary grid member 10, including any bulb portion 16. If the primary grid member 10 has a bulb 16, the first fastener portion 22 can be snap-fastened to the primary grid member 10 by forcing it down over the bulb 16. The opposing legs 32, 34 can be slightly spread at the bottom to form an inverted-V channel 37 to allow easier attachment of the clip onto the primary grid member 10 having a bulb 16. The bulb 16 of different grid members 10 can vary somewhat but are typically of similar width so that a single size of downwardly opening V-shaped channel 37 should be suitable for use with most grid members.

When inserted into channel 36, the primary grid member 10 is slidably secured therein by the crimping of the resilient opposing leg portions 32, 34 about the vertical web 14 of the primary grid member. The clip 20 is prevented from moving upwardly away from assembled relation by the engagement of the leg portions 32, 34 with the underside of the bulb 16 of the primary grid member 10. The apex of the inverted-V channel 37 should be sufficiently tight to provide support for the underside of the bulb 16 of the vertical web 14.

Each leg portion 32, 34 may include one or more inwardly detents 38 stamped inwardly in a direction toward the opposing leg. The detents 38 further assist in engaging the vertical web 16 of the primary grid member 10 in a generally snug, gripping relationship in channel 36, thereby further resisting longitudinal movement of the primary grid member 10 in channel 36. However, during seismic activity, the primary grid member is able to move within channel 36 in a direction shown by Arrow L despite this resistance.

Each clip 20 further includes second and third resilient fastener portions, 24 and 25 respectively, also referred to as "cross grid member supports", extending from, and integrally connected to, the first resilient fastener portion 22 in generally perpendicular relation. The second resilient fastener portion 24 effectively attaches a first cross grid member 12 to the primary grid member 10. Likewise, the third resilient fastener 25 portion effectively attaches a second cross grid member 12 to the primary grid member 10.

Figure 3:
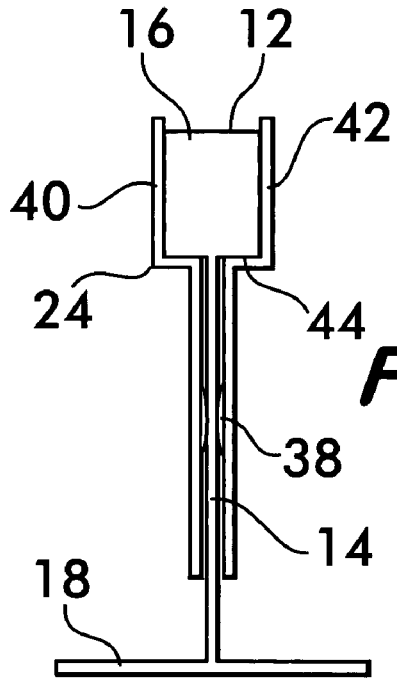
FIG. 3 is an elevation view of cross grid member inserted into the clip of FIG. 1.

Each resilient fastener 24, 25 has two opposing clip webs 40, 42 which generally follow the geometry of the web 14 (and bulb 16) of a secondary grid member 12. In this embodiment, the top of each cross tee support is open forming a channel 44 having generally a Y-shaped cross section. FIG. 3 shows cross grid member 12 received in the channel 44 of resilient fastener 24. As shown, the clip webs 40, 42 contour to the shape of the vertical web 14 and are spaced so as to provide a snug fit about the grid member 12. The grid member 12 is secured in channel 44 by the crimping of the clip webs 40, 42 about the vertical web 14.

In a conventional configuration, a cross grid member 12 is typically supported by a lower horizontal flange 18 of the primary grid member 10. Here, support for the cross grid member 12 by the primary grid member is not required as the clip webs are contoured to the underside of the bulb 16 of the secondary grid member 12. Thus, resilient fastener 24 alone can support the secondary grid member 12. This is particularly important during a seismic disturbance when cross grid member 12 is displaced in the directions shown by arrow M in FIG. 1. A clip web length of at least 2 inches is preferable in order to safely comply with ASTM E 580-02.

Each clip web 40, 42 may also include one or more detents 38 stamped inwardly in a direction toward the opposing leg. The detents 38 assist in engaging the vertical web 16 of the secondary grid member 12 in a generally snug, gripping relationship, to resist any withdrawal movement of the secondary grid member 12 from fastener portions 24 and 25. Despite this resistance, during seismic activity, the secondary grid member 12 is able to move in channel 44 in the directions indicated by Arrow M.

Figure 4:
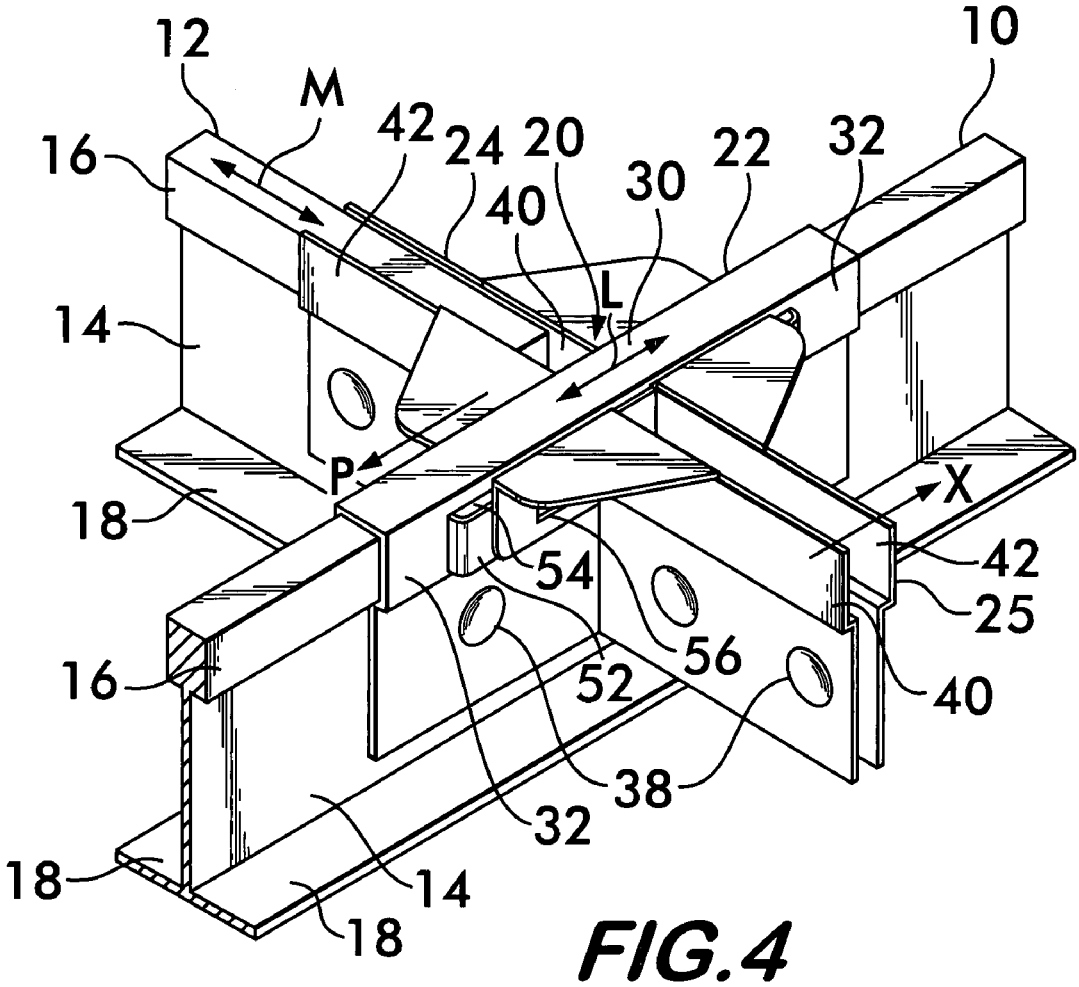
FIG. 4 is a fragmentary perspective view of the ceiling system illustrating the joint portion of the system to which an alternate embodiment of the clip of the invention is shown mounted.

Since the direction of the motion of the independent ceiling areas during an earthquake is unpredictable it may be possible that two ceiling areas, and therefore their respective cross beams, on either side of a separating primary grid member move in opposite directions lengthwise along the primary grid member, i.e. in opposite directions of the horizontal directions indicated by Arrows P and X in FIG. 4.

Figure 5:
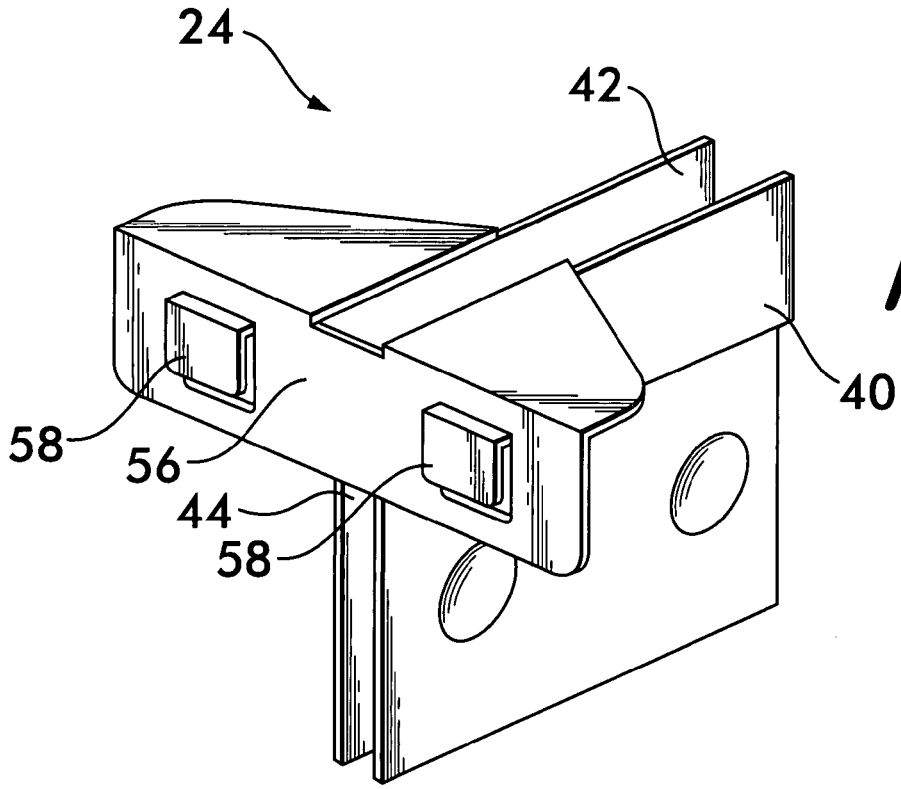
FIG. 5 is a perspective view of a cross member support portion of the clip shown in FIG. 4.
Figure 6:
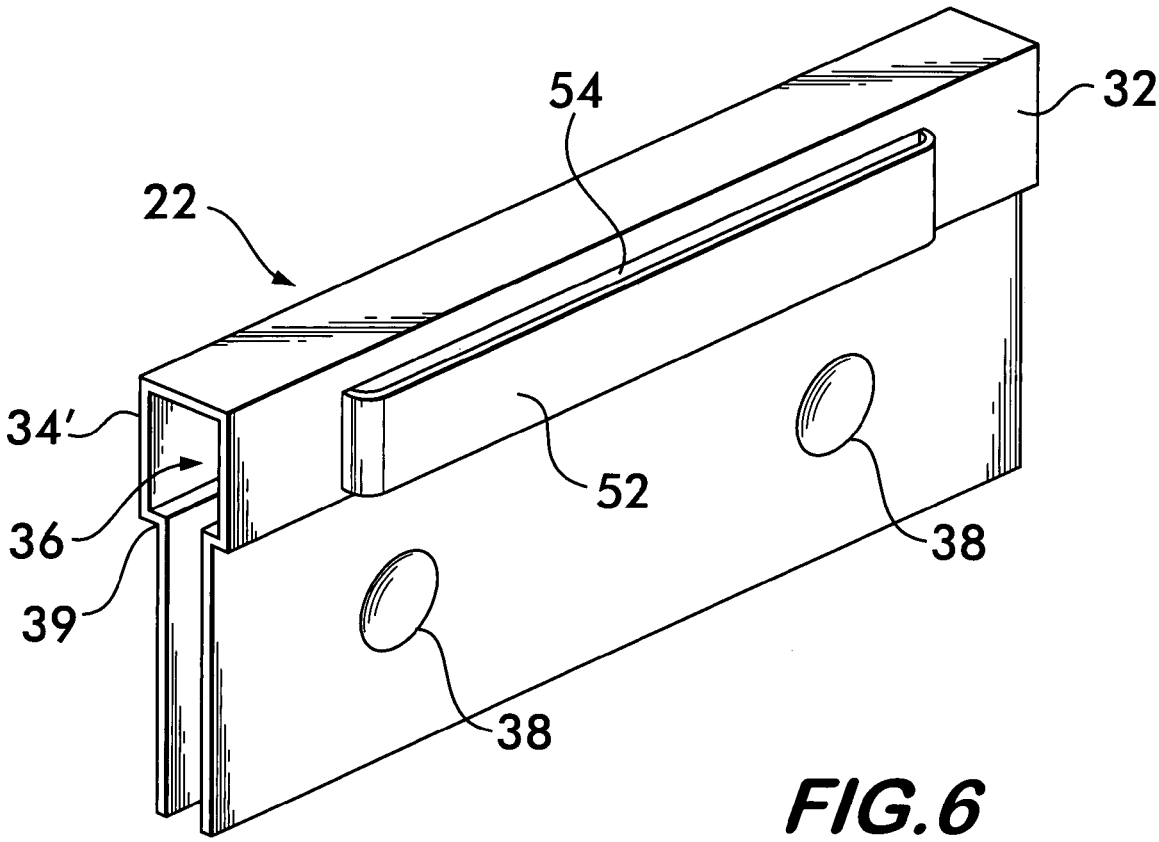
FIG. 6 is a perspective view of a main body portion of the clip shown in FIG. 4.

The example embodiment of the joint clip shown in FIGS. 4-6 permits independent motion of the secondary grid members 12 in the four horizontal directions. The key is that each cross member moves independent of one another and is not dependent on the sliding engagement of the first fastener portion to the primary grid member. In other words, the first fastener portion can be fixedly attached to the primary grid member. It should be noted that the fastening portions illustrated in the second alternative embodiment are individual components and are attached to one another to form the joint clip.

In this configuration, each opposing leg 32, 34 of the first fastener portion 22 has a clip carrier 52 which is defined by a carrying slot 54 stamped in the leg of the first fastener portion 22. The second and third fastener portions 24, 25 of the first embodiment are modified to include a face plate 56. The face plate 56 integrally extends from the top of the clip webs 40, 42 in a downward direction but is spaced from the side edge of the clip webs. The face plate 56 contains one or more downwardly extending planar tabs 58 stamped out of the face plate 56 with the top of the tabs 58 integrally attached to the face plate 56. The tabs 58 engage carrying slot 54 of the first fastener portion 22. When engaged, the second or third fastener potion 24, 25, and, thus, a cross grid support member 12 attached thereto, can slide along the clip carrier 52 in carrying slot 54, in the directions indicated by Arrows P and X in FIG. 4. As before, the cross grid member 12 retains its freedom of horizontal motion in channel 44, i.e. in a directions perpendicular to the primary grid member 10 as indicated by Arrow M.

2. The Embodiment of the Joint Clip of the Invention Shown in FIGS. 12 through 16 a) The Structure of the Clip

The embodiment of the joint clip 60 of the invention shown in FIGS. 12 through 16 is formed of identical segments 61 and 62 that telescope loosely together to form the clip 60. Each segment 61, 62, has an overhang 63 intended to ride on, and extend perpendicular to, a main beam 90 in a connection of the invention 66, and a pair of underhangs 67, each extending below, and integral with, overhang 63, on each side of the main beam 90.

Segments 61, 62 are loosely connected and capable of moving slightly independently of each other longitudinally of a main beam 90 at an intersection in a connection of the invention.

Overhang 63 is formed with a horizontal top 68 that has, depending downward, a lip 70 at one side, and a wall 71 on the opposite side.

Overhang 63 includes a projection 83, which is intended to telescope with overhang 63 on an opposing segment 61. Projection 83 has a wall 81 that extends in alignment with the wall 71. The top of projection 83 is narrower than, and slightly depressed below, top 68. There is a transition slope 88 between top 68 and the top projection 83.

In each of the segments 61, 62, the walls 71 and 81, which are an extension of each other, form a cut-out 72 that is slidably secured on a main beam 90. The assembled joint clip 60 is free to oscillate along the main beam 90 during an earthquake, while still secured to the main beam 90, at a right angle.

The cut-out 72 in each segment 61, 62, conforms to the shape of the bulb 91 of main beam 90. The cut-out 72 may be, for instance, one with a peak 92 that conforms to a bulb 91, as seen in the '416 patent. Cut-out 72 has right angle bends at 75 and 76 that straddle the main beam 90 and keep the joint clip 60 oriented at right angles to the main beam 90. Cut-out 72 has at the bottom thereof, in each segment 61, 62 at one side of the cut-out 72, a vertical positioning stay 94. Stay 94 is sloped on the lower side to permit a forced insertion over bulb 91 of main beam 90. The stay 94 has a horizontal stop at the top, to prevent upward movement of the joint segments 61 and 62 once the clip 60 is forced into position on the main beam 90.

The joint segments 61 and 62, have enough play to permit a slight movement of the segment relative to one another to place the joint in position on bulb 91 of the main beam 90.

Stay 94, as so positioned, limits upward movement or dislodgment of clip 60 from main beam.

Figure 14:
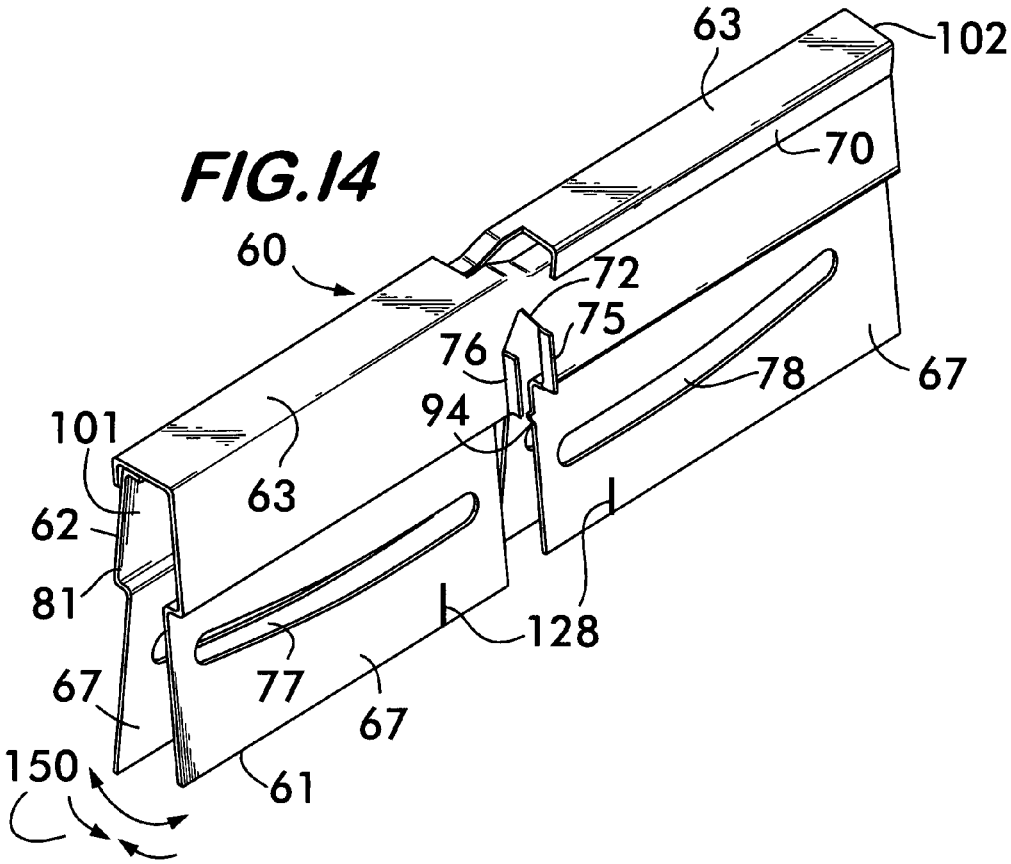
FIG. 14 is a perspective view of the embodiment of the clip of the invention shown in FIGS. 13 and 14, with the two parts assembled, prior to installation at a connection in the grid, showing the parts rotated apart from one another.
Figure 15:
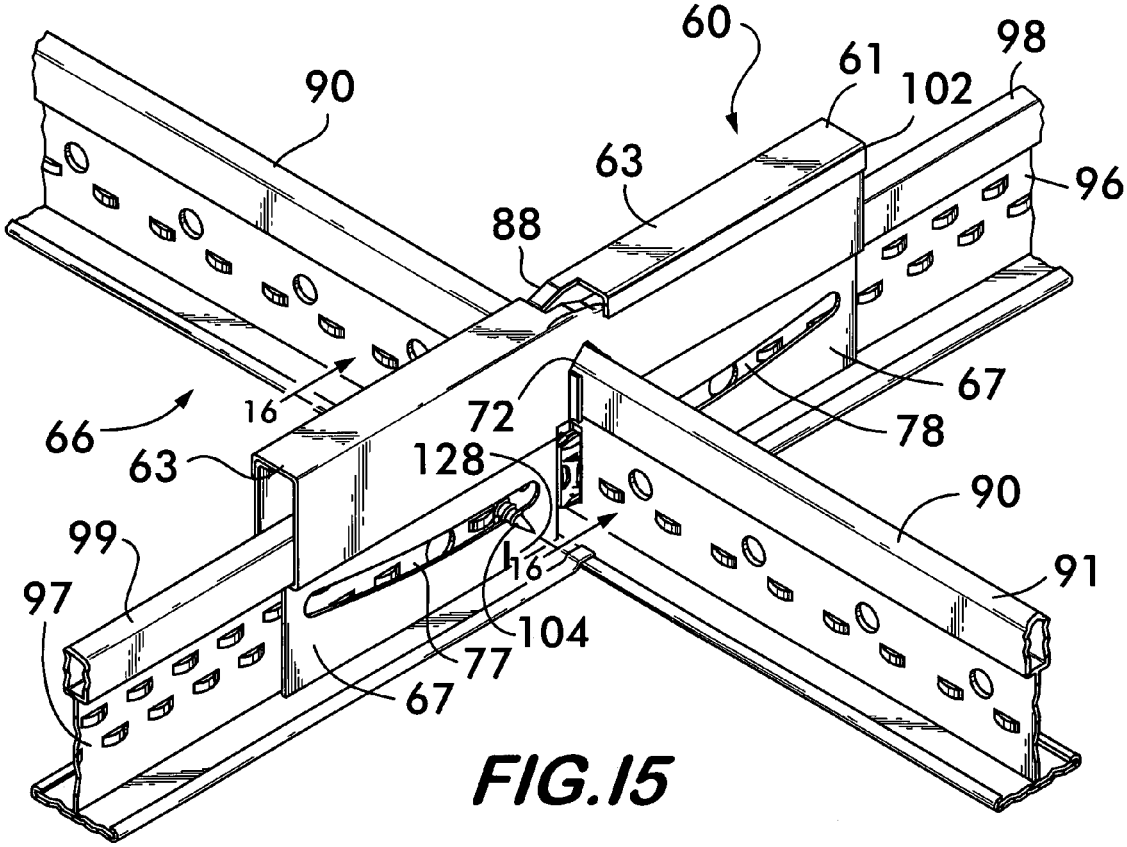
FIG. 15 is a perspective view of the join of the joint clip shown in FIGS. 12 through 14 installed at an intersection in a seismic grid.
Figure 16:
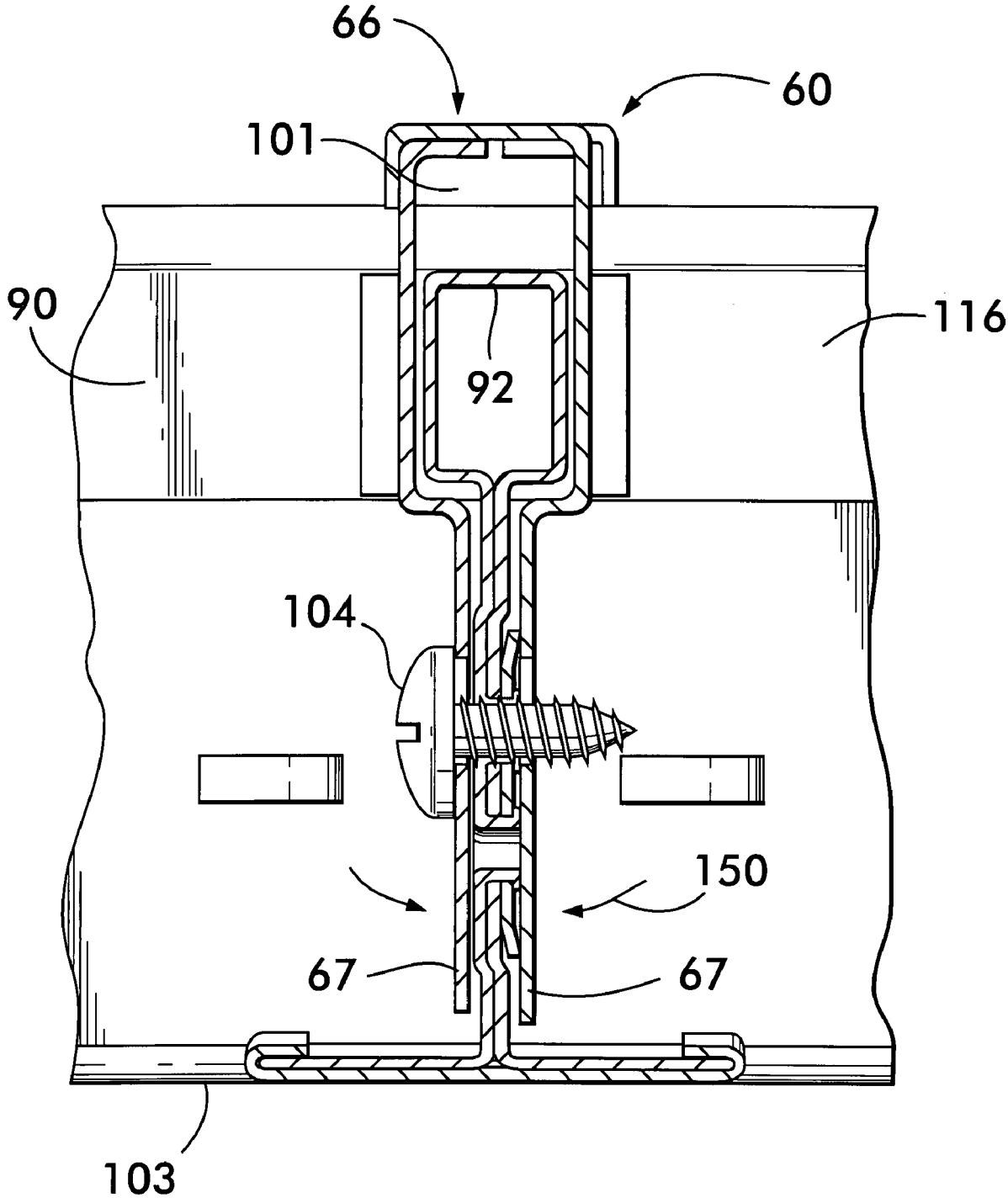
FIG. 16 is a sectional view taken on the lines 16-16 of FIG. 15.

The lower horizontal top of a projection 83 of a segment 61, 62, permits a telescoping action when segments 61, 62 are assembled to form the joint clip 60 shown in FIGS. 14 through 16. The segments 61 and 62 are kept interconnected together when the clip 60 is inserted over main beam 90, since bulb 91 on the main beam 90 extends within cut-out 72 on the assembled clip 60, preventing the segments 61 and 62 from sliding apart.

The segments 61 and 62 are assembled by telescoping each toward the other longitudinally to the aligned position, wherein overhang 63 receives in each segment 61, 62 a projection 83 from the opposing segment.

As seen in FIGS. 14 and 16, the segments 61 and 62, when assembled by a telescoping action, are interconnected at the top through the overhangs 67, although the segments 61 and 62 can slightly move with respect to one another, as shown by arrows 150.

Slots 77 and 78, having a horizontal section 93 and an inclined section 95, are formed in the underhang 67 of each segment 61 and 62. When the segments 61 and 62 are assembled, as shown in FIG. 14, opposing slots 77 and 78 align and cut-outs 72 in each segment 61 and 62 also align.

b) How the Clip Functions

The function of joint clip 60, as with the other embodiments set forth above, is to permit the main beam 90, and each of the cross beams 96, 97 in an intersection in a suspended ceiling grid 130, to move independently of one another in an earthquake. As can be seen particularly in FIGS. 12 and 15, clip 60 is free to move back and forth longitudinally along main beam 90, since it is only slidably connected to the beam 90 by cut-out 72.

The cross beams 96 and 97 are assembled into, and are free, to ride back and forth within overhang 63 and underhang 67, in pockets 101 and 102 whose cross section conforms generally to the cross sections of the bulbs 98 and 99 and webs 101 of cross beams 96, 97. Cross beams 96 and 97 are slidably supported by self-tapping screws 104 that pass through slots 77 and 78, with horizontal section 93 and inclined section 95. The screws 104 are free to slide in the slots 77 and 78, and, since they are embedded in the webs 101 of the cross beams 96, 97, the screws 104 lift and drop the end of a cross beam 96, 97 as the cross beam travels longitudinally back and forth toward the main beam 90, during an earthquake. As the cross beams 96 and 97 move toward and away from the main beam 90 during a quake, the ends of the beams 96, 97 are lifted and lowered, to avoid interference between the cross beam end and the flange 103 of the main beam 90.

Markings 128 serve as vertical positioning indicia for locating the self-tapping screws 104 into the ends of cross beams 96, 97.

c. Where the Clips are Installed

Figure 8:
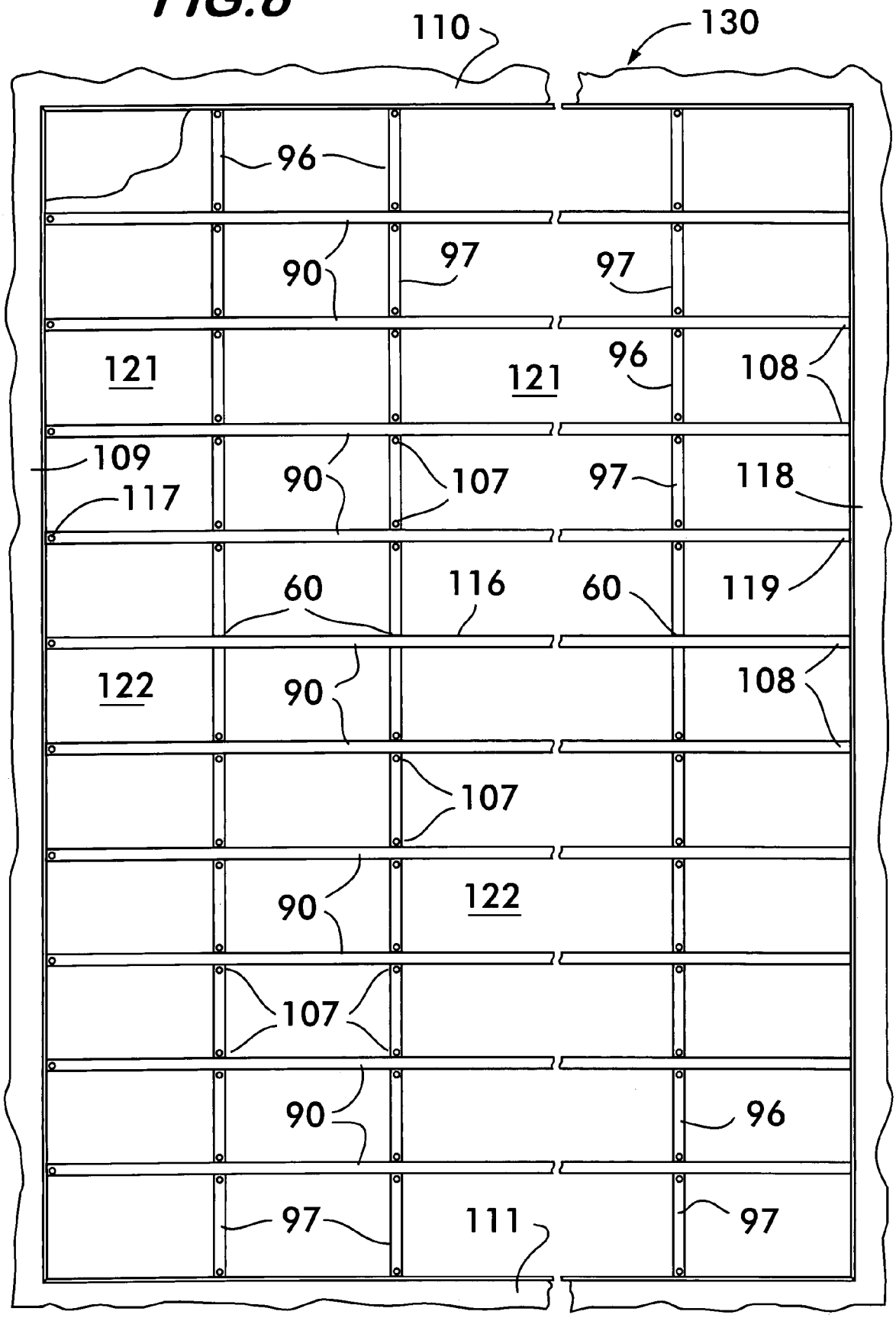
FIG. 8 is a symbolic plan view of a ceiling grid, using the joint clip of the invention.

FIG. 8 is a symbolic representation of a ceiling grid 130 for a suspended ceiling able to withstand earthquakes, using the clips 90 of the invention to create a ceiling grid with areas 121, 122 of 2500 square feet or less that shake independently of one another during a quake. The same principle of isolating multiple sections, in excess of the two shown in FIG. 8, would be used in larger ceilings.

Figure 9:
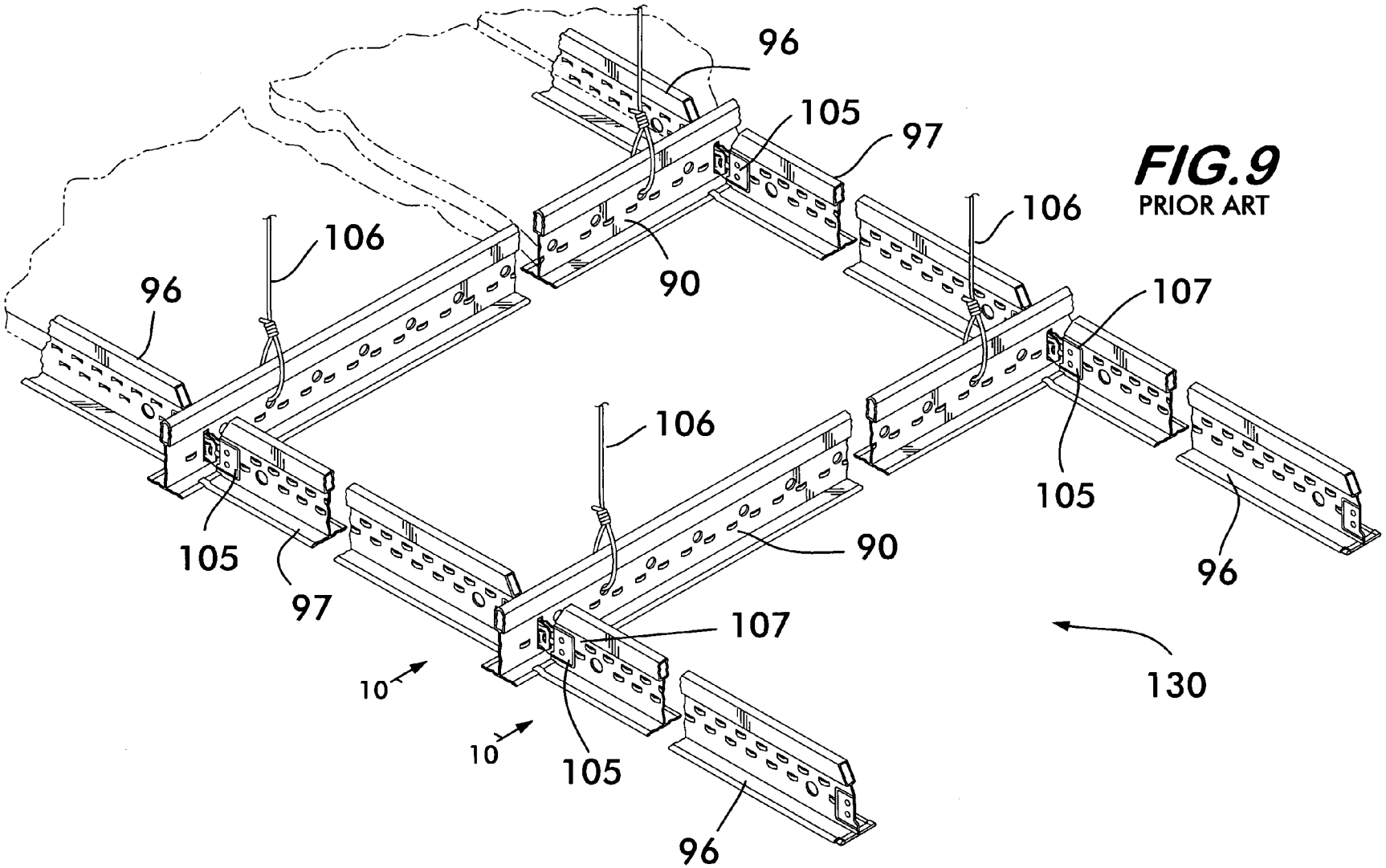
FIG.9 PRIOR ART
FIG. 9 is a perspective view of a section of ceiling grid capable of using the joint clip of the invention.

In FIG. 8, there is shown a plan view of a ceiling grid 130 for a suspended ceiling, using the joint clips 60 of the invention, in a room that exceeds 2500 square feet in area. The room has first installed therein suspended from a structural ceiling, a conventional grid for a suspended ceiling, as shown, for instance, in U.S. Pat. No. 6,178,712, incorporated herein by reference, having a series of parallel main beams 90, generally spaced 4 feet apart, and cross beams 96 and 97 joined to the main beam 90 at fixed connections 107. The main beams 90 are supported from the structural ceiling by hang wires 106. A segment of such a conventional ceiling grid is shown in FIG. 9, with a fixed connection 107 shown in detail, in FIG. 10.

To form the seismic grid of the invention for the suspended ceiling 130, the ends of each main beam 90 adjoining room wall 109, and the ends of each cross beam 96 and 97 adjoining room walls 110 and 111, are fixed to such walls, as by riveting to a wall molding, as well known. In FIG. 8, such a fixed connection at the walls is shown symbolically by a single small circle. Also, the symbol of a small circle is used to show a fixed connection 107 between a main beam 90 and cross beam 96, 97 as shown, for instance, in FIGS. 9 and 10.

The ends of main beams 90 along room wall 118 are not connected to the wall, but simply lie on the wall molding, as at 108, and are free to move thereon during a quake. This freedom to move is shown symbolically in FIG. 8 by an absence of small circles.

After the conventional ceiling grid is completed, the ceiling is divided into areas of 2500 feet or less by inserting the clips 60 of the invention along a selected main beam, or beams, 116. In FIG. 8, there is only one main beam 116 with clips 60 shown, to illustrate the invention. A selected beam or beams 116 are determined by dividing the total length of the run of all main beams in the grid, in feet, into 2500 square feet, to yield the maximum spacing, between runs of a selected main beam 116, that requires joint clips 60 of the invention.

In FIG. 8, the joint clips 60 of the invention have been installed along selected main beam 116. The selected main beam 116 is tied to wall 109 at one end at 117, and free to slide with respect to room wall 118 at the other end 119, as indicated symbolically in FIG. 8, during a quake.

When a ceiling grid is divided into areas 121, 122 of 2500 square feet or less, as shown in FIG. 8, the clips 60 of the invention permit each such area 121, 122 to move independently of the other area 121, 122, preventing a buildup of undesirable momentum of the entire ceiling grid.

d) How the Clips are Installed

Figure 10:
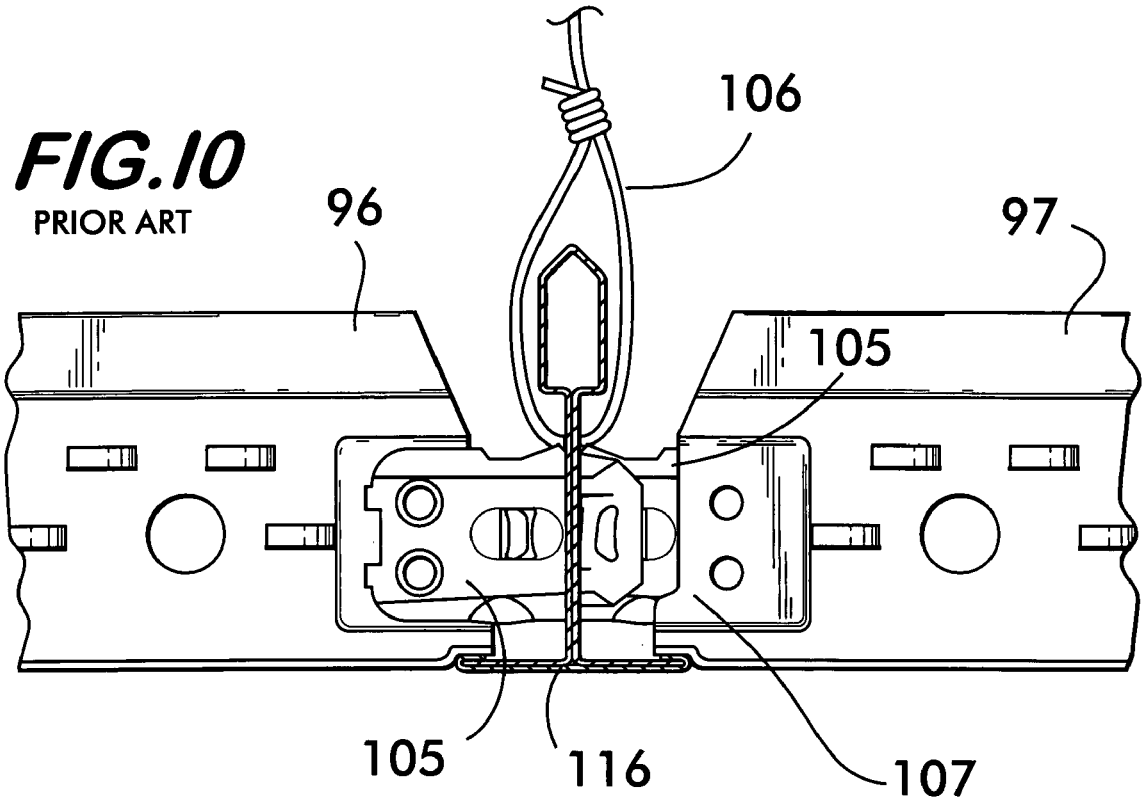
FIG.10 PRIOR ART
FIG. 10 is a side elevational view taken on the line 10-10 of FIG. 9, showing a grid intersection prior to inserting a joint clip of the invention into the grid.

In installing the present embodiment of a seismic separation joint clip 60, into a suspended ceiling grid, a conventional suspended ceiling grid is first assembled, with connectors at intersections that are fixed. An example of such a grid and connectors is shown in detail, for instance, in the '712 patent referred to above. A section of such a prior art grid in a conventional suspended ceiling is shown in FIG. 9 of the present drawings, wherein main beams 90 receive cross beams 96 and 97. As seen in FIG. 10, stab through connectors 105 as shown, for instance, in the '712 patent, pass through slots in main beam 90 as well known. Such a connector 105 is shown in detail in FIGS. 10 and 11.

Figure 11:
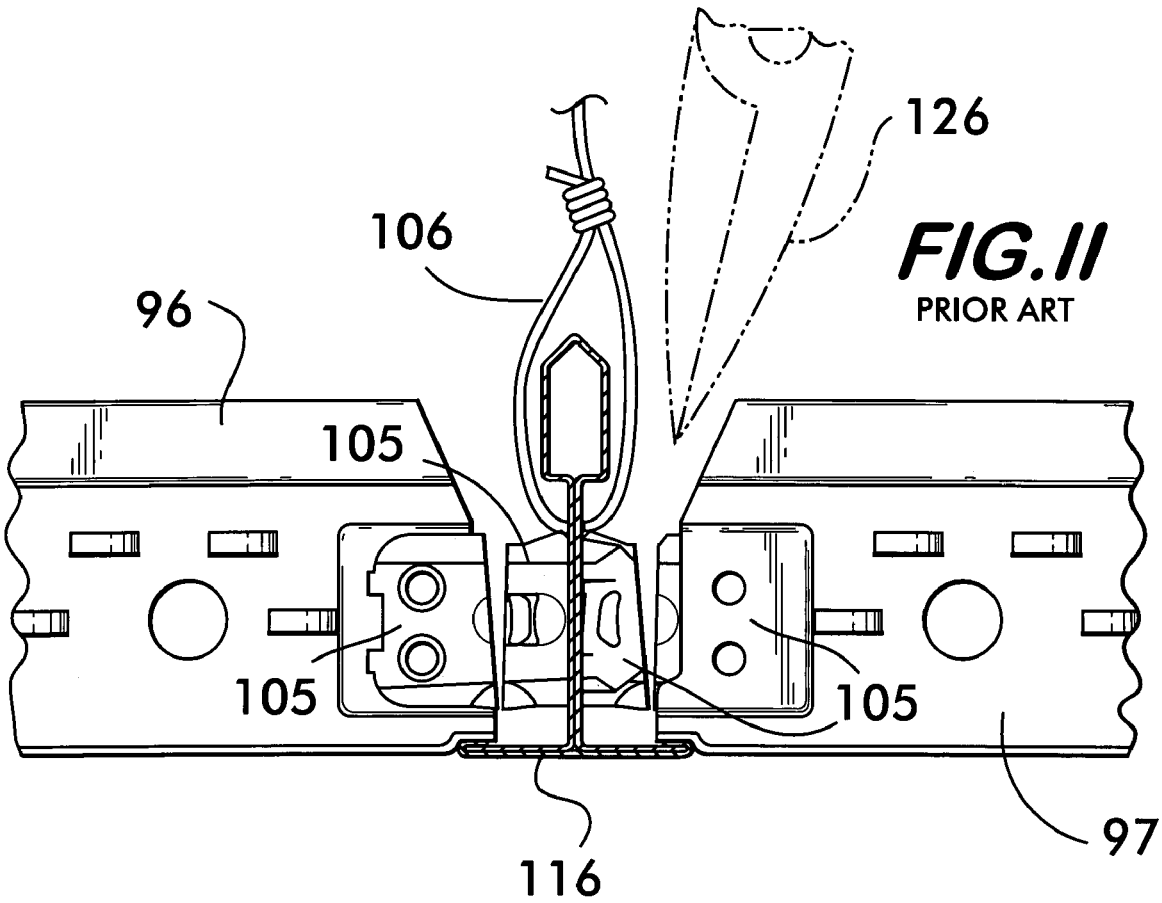
FIG.11 PRIOR ART
FIG. 11 is a view similar to FIG. 10 showing the partial cutting of the existing connection of FIG. 10, in preparation for the insertion of a joint clip of the invention.

To install the joint clip 60 of the invention at an intersection on a selected main beam 116, a fixed connector 105 is cut through as shown in FIGS. 10 and 11, one intersection at a time, to prevent grid collapse, and the joint clip 60 of the invention is inserted. The prior art connectors 105 on each side of selected main beam 116, are snipped through with hand shears 126, and the sheared off portions of the connectors 105 removed from the connection.

To insert the joint clip 60 of the invention, segments 61 and 62 of the clip 60 are assembled as shown in FIG. 14, and snapped over the selected main beam 116, at the connection where the cut has been made, as seen particularly in FIG. 15. The ends of cross beams 96, 97 are inserted from each side of selected main beam 116 into the clip pockets 100, 101, as seen in FIG. 15.

A self-tapping screw 104 is inserted through the slots 77, 78 in the clip 60 into an end of the cross beam 96, 97. The screw 104 extends through slots 77, 78, on each side of the end of a cross beam, and serves as an axle as it rides in the slots, both horizontally, and at an incline.

A vertical stamp mark 125 below the horizontal segment 93 of slot 77, 78 is used to properly position the screw 104 within the clip 60. The screw 104 is installed from opposite sides of the assembled clip 60, on each side of the selected main beam 116. Thus screw 104, in addition to its function of slidably securing the cross beam 96, 97 ends in the clip, serves to aid in keeping clip 60 assembled.

e) How the Clips Act During an Earthquake

As seen in FIG. 8, areas 121 and 122 in suspended ceiling grid 130 are separated from one another by a series of joint clips 60, along a selected main beam 116.

During an earthquake, areas 121 and 122, in FIG. 8, move independently of one another.

e.1) Transmission of Forces Longitudinally of (Along) Selected Main Beam 116

Forces, and vectors of forces, that in a quake, shake the area 121, 122, in a direction longitudinally of selected main beam 116, are not transmitted between areas 121, 122, since cut-out 72 slides longitudinally along beam 116 without transmitting any force between the main beam 116 and either/or both of the cross beams 96, 97. The ends of cross beams 96 and 97, extending into pockets 100, 101 of a clip 60, shake against each side of the clip 60, which sides are slightly movable with respect to one another, so there is no direct transmission of the forces to the cross beam 96, 97 on the opposite side of the selected main beam 116. Thus, no substantial forces are transmitted between areas 121, 122, in a direction longitudinally of the selected main beam 116 during a quake, between the selected main beam 116 and either cross beam 96, 97, or between opposing beams 96, 97.

e.2) Transmission of Forces Laterally of (Across) Selected Main Beam 116

Forces, and vectors of forces, that, during a quake, shake the area 121, 122 laterally, of selected main beam 116 through cross beams 96, 97, are not transmitted through clip 60, since the ends of cross beams 96, 97, simply slide in and out of pockets 100, 101 in clip 60, while supported from slots 77, 78.

e.3) Summary

No substantial forces are transmitted along, or across, selected main beam 116, thus isolating the areas 121, 122 from each other, so there is no momentum build-up of the entire ceiling.

The invention claimed is:

1. In a ceiling grid for a suspended ceiling intended for use in zones subject to earthquakes, the improvement comprising a joint clip that (1) in a connection in the grid between a main beam and a pair of cross beams, each of which extends from an opposite side of the main beam, (2) permits, during an earthquake, the main beam and each of the pair of cross beams to move independently of one another, without transmitting forces between or among the beams;

(3) is formed of a pair of loosely connected segments movable with respect to one another longitudinally of the main beam; and (4) has a) an overhang that extends above, and laterally across, the main beam and is slidably secured to the main beam by a cut-out in the overhang that conforms in shape generally to the cross-section of the bulb in the main beam, with a stop below the cut-out;

b) an underhang on each side of the main beam integral with the overhang, that forms, with the overhang, a pocket that conforms in shape generally to the bulb and web in the cross beam, on each side of the main beam, and that extends laterally of the main beam over each cross beam, and slidably receives a cross beam, and;

c) slots in each underhang that slidably receive a screw embedded in an end of the cross beam;

whereby, by using a clip at connections along a selected main beam in the ceiling grid, one area of the ceiling grid is isolated from forces created in another area of the ceiling grid, during the earthquake.

2. The beam of claim 1, wherein the joint clip is formed of a pair of overlapping segments telescoped together.

3. The improvement of claim 1, wherein each of the slots has a horizontal portion, and an inclined portion.

4. The improvement of claim 1, wherein the clip has a right angle bend on a side of the cut-out to keep the joint clip oriented laterally to the main beam.

5. The improvement of claim 1, wherein markings on the clip serve as vertical positioning indicia for locating the screw in the end of a cross beam.

* * * * *